US008002129B1

(12) United States Patent
Reyes

(10) Patent No.: US 8,002,129 B1
(45) Date of Patent: Aug. 23, 2011

(54) LIQUOR BOTTLE DEVICE

(76) Inventor: Franny D. Reyes, Providence, RI (US)

( * ) Notice: Subject to any disclaimer, the term of this patent is extended or adjusted under 35 U.S.C. 154(b) by 351 days.

(21) Appl. No.: 12/266,330

(22) Filed: Nov. 6, 2008

(51) Int. Cl.
*B65D 1/04* (2006.01)

(52) U.S. Cl. ..... 215/6; 215/387

(58) Field of Classification Search ..... 215/6, 387
See application file for complete search history.

(56) References Cited

U.S. PATENT DOCUMENTS

| | | | | | |
|---|---|---|---|---|---|
| 2,362,223 | A | * | 11/1944 | Platkin | 215/6 |
| 2,543,427 | A | * | 2/1951 | Warne | 141/381 |
| 3,021,977 | A | * | 2/1962 | Hester | 220/718 |
| 3,262,596 | A | | 7/1966 | Zillmann | |
| 3,913,770 | A | | 10/1975 | Tarro | |
| D242,692 | S | | 12/1976 | Mitchell | |
| 4,323,172 | A | | 4/1982 | Lim | |
| D275,651 | S | | 9/1984 | Chajet | |
| D306,695 | S | | 3/1990 | Smith | |
| 5,086,926 | A | * | 2/1992 | Paige et al. | 206/542 |
| D386,950 | S | | 12/1997 | Dettmar | |
| 6,105,812 | A | * | 8/2000 | Riordan | 220/504 |
| 6,588,621 | B2 | | 7/2003 | Shimazaki | |
| D503,589 | S | | 4/2005 | Schuler | |
| 2002/0148247 | A1 | | 10/2002 | Connors et al. | |
| 2005/0218102 | A1 | * | 10/2005 | Guilford et al. | 215/11.1 |
| 2008/0142466 | A1 | * | 6/2008 | Balitski | 215/6 |

FOREIGN PATENT DOCUMENTS

WO WO2005028330 * 3/2005

* cited by examiner

*Primary Examiner* — Tri M Mai

(57) ABSTRACT

A liquor bottle device for holding liquor comprising a bottle portion and a bottom chamber inside the bottle portion at the bottom. The liquor bottle device can be constructed from a material comprising a thermal glass so as to keep the contents of the device cool. The bottle portion is for holding liquor and comprises two shot glasses disposed in an first inner compartment and a second inner compartment. The bottom chamber can hold ice to keep the contents of the bottle cool. A screw-on cap is disposed at the top of the bottle portion and functions as an additional shot glass.

3 Claims, 2 Drawing Sheets

LIQUOR BOTTLE DEVICE

FIELD OF THE INVENTION

The present invention is directed to a bottle for holding liquor. More particularly, the present invention is directed to a bottle for holding liquor having shot glasses and a bottom chamber for ice.

BACKGROUND OF THE INVENTION

The present invention features a liquor bottle device for holding liquor. The liquor bottle of the present invention comprises one or more shot glasses, as well as a bottom chamber for holding ice to keep the contents of the bottle cool. A screw-on top cap is disposed at the top of the bottle portion and functions as an additional shot glass.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
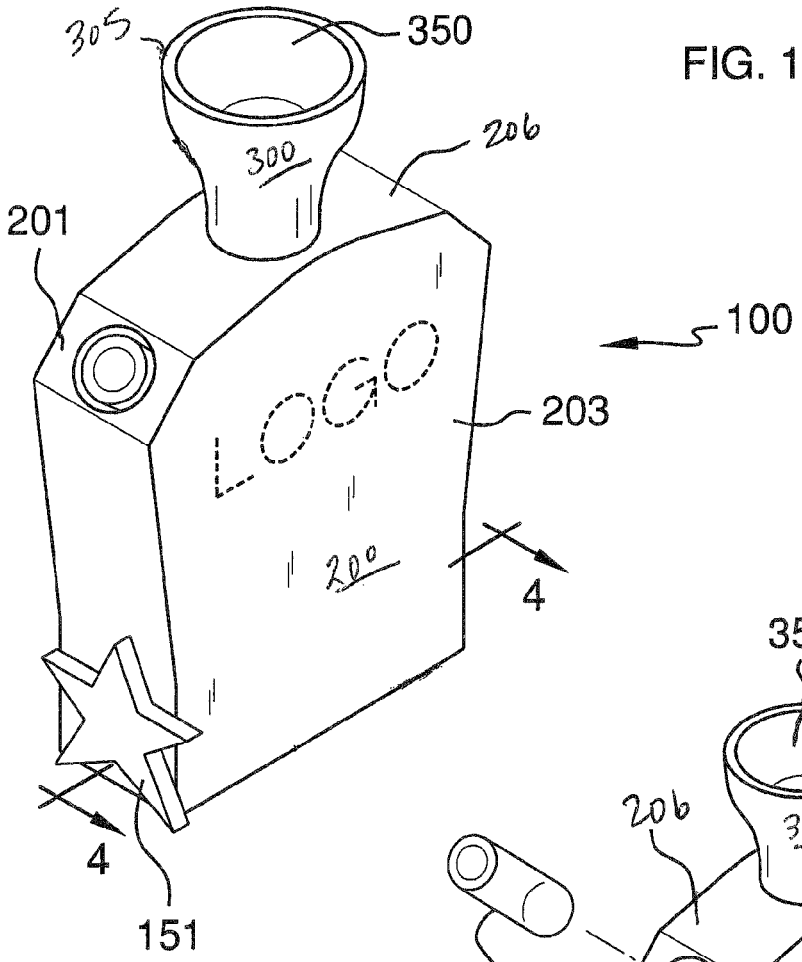
FIG. 1 is a perspective view of the liquor bottle device of the present invention.
Figure 2:
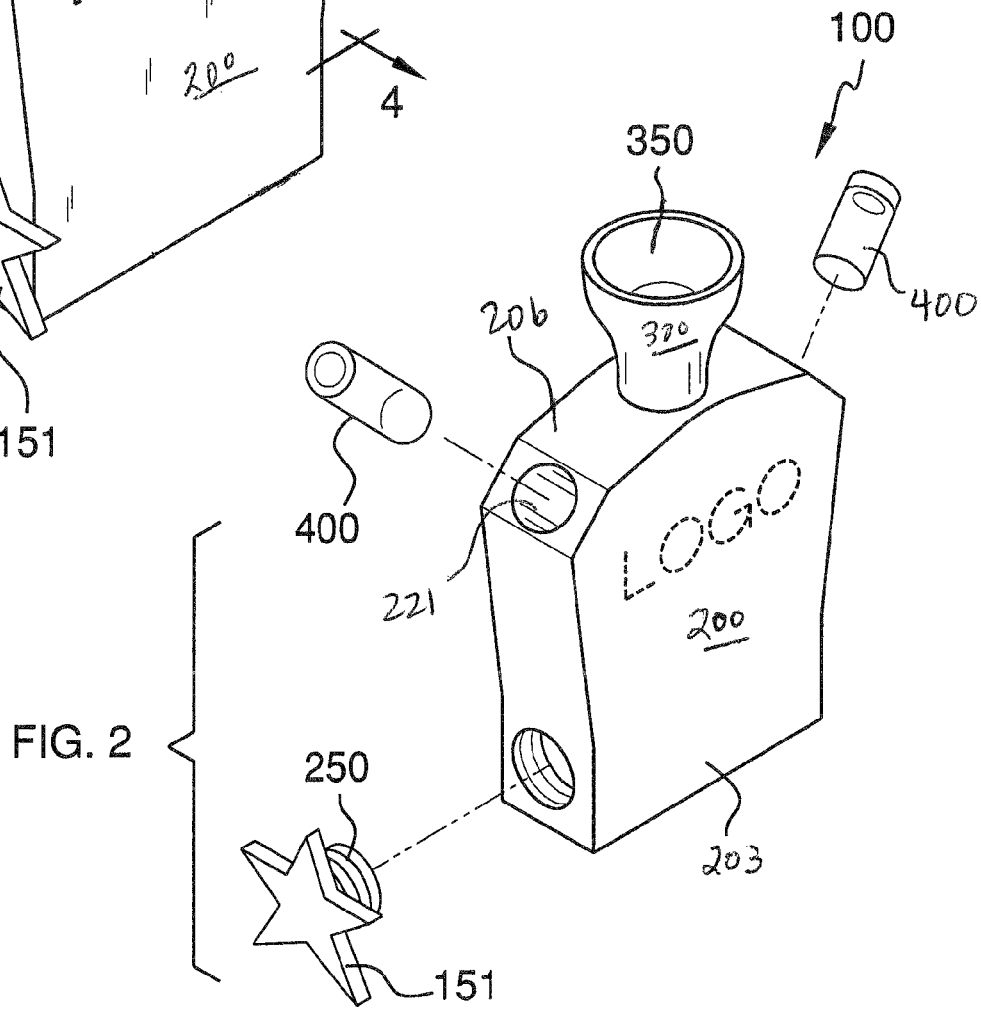
FIG. 2 is a perspective view of the liquor bottle device of the present invention.
Figure 3:
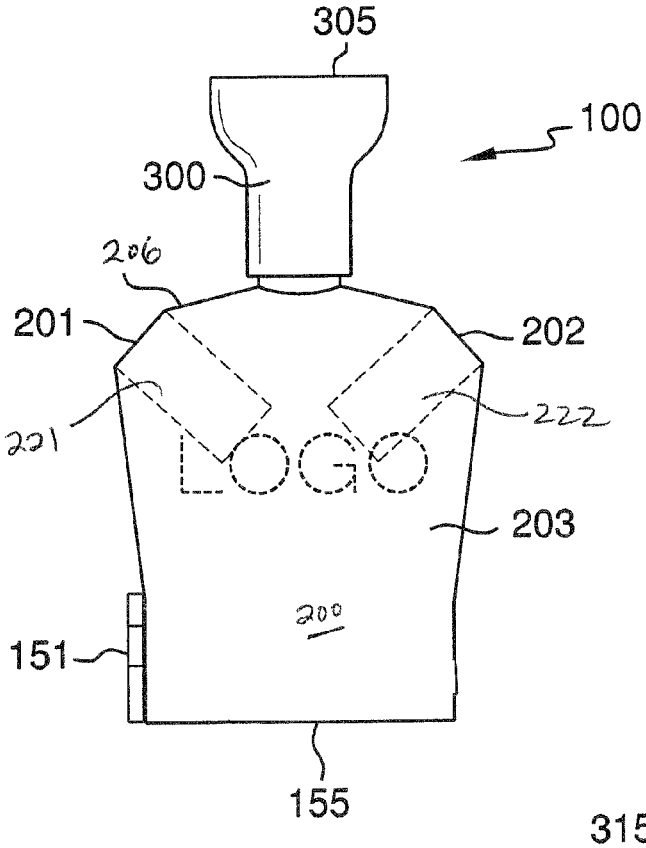
FIG. 3 is a front view of the liquor bottle device of the present invention.
Figure 4:
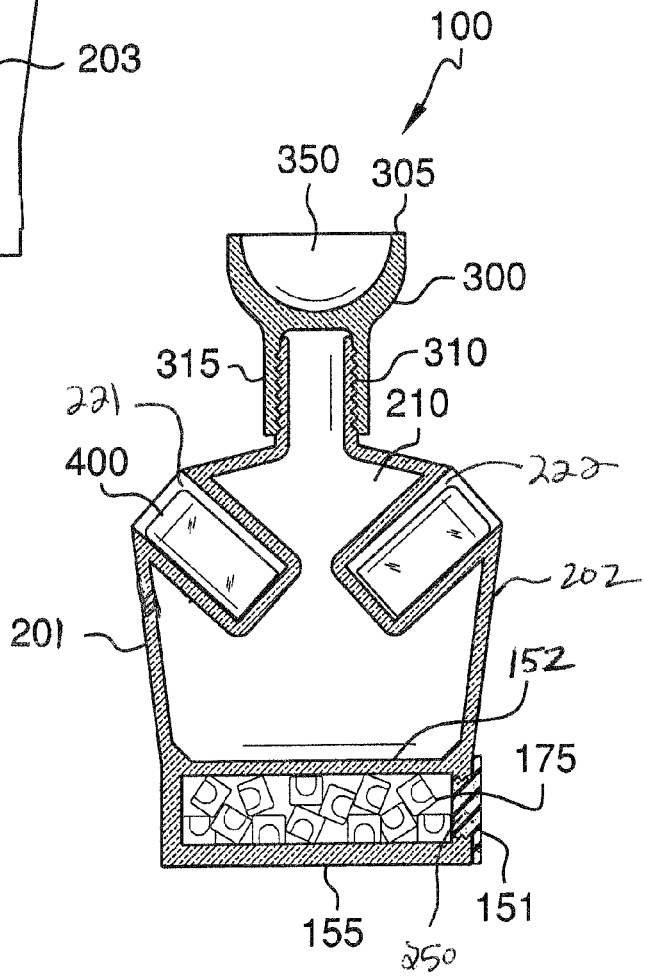
FIG. 4 is a front view and cross-sectional view of the liquor bottle device of the present invention.

The following is a listing of numbers corresponding to a particular element refer to herein:

100 liquor bottle device
150 bottom chamber
151 decoration of side cap
152 top wall of bottom chamber
155 bottom of bottle portion
175 ice
200 bottle portion
201 first side wall of bottle portion
202 second side wall of bottle portion
203 front face of bottle portion
206 top of bottle portion
210 inside of bottle portion
221 first inner compartment
222 second inner compartment
250 side cap
300 top cap
305 top end of cap
310 male threaded component of top of bottle portion
315 female threaded component of cap
350 open portion of cap (e.g., shot glass)
400 shot glass Referring now to FIGS. 1-5, the present invention features a liquor bottle device 100 for holding a liquid (e.g., a liquor). The liquor bottle device 100 of the present invention comprises one or more shot glasses 400 insertable into the bottle portion 200, as well as a bottom chamber 150 for holding ice to keep the contents of the liquor bottle device 100 cool. Without wishing to limit the present invention to any theory or mechanism, it is believed that the liquor bottle device 100 of the present invention is advantageous because it neatly stores shot glasses 400 inside the bottle and simultaneously provides a user with a means of chilling the contents of the bottle. This eliminates the need to buy separate shot glasses, and helps prevent a user from losing the shot glasses by providing a safe means of storing the shot glasses. The liquor bottle device 100 of the present invention also provides aesthetic appeal.

The liquor bottle device 100 of the present invention comprises a bottle portion 200. In some embodiments, the bottle portion 200 is for holding a liquor or other liquid. The bottle portion 200 has a front face 203, a back face, a bottom, a top 206, a first side wall 201, a second side wall 202, and an inside 210. A bottom chamber 150 is disposed at the bottom of the bottle portion 200 and is separated from the inside 210 of the bottle portion 200 via a top wall 152.

A first hole is disposed in the first side wall 201 of the bottle portion 200 at the bottom chamber 150. The first hole allows a user to insert or remove ice into or out of the bottom chamber 150. A side cap 250 is removably attached to the first hole. The side cap 250 allows a user to access the bottom chamber 150. In some embodiments, the side cap 250 can be attached to the first hole in the first side wall 201 via a screw mechanism. In some embodiments, the side cap 250 can be attached to the first hole in the first side wall 201 via a snap mechanism. In some embodiments, a user can insert ice 175 into the bottom chamber 150 so as to cool the liquid contents in the inside 210 of the bottle portion 200. In some embodiments, the side cap 250 prevents leaking of the contents of the bottom chamber 150.

In some embodiments, the bottle portion 200 and bottom chamber 150 of the liquor bottle device are constructed from a material comprising a thermal glass. In some embodiments, the side cap 250 comprises a decoration 151. For example, in some embodiments, the decoration 151 can include an item in various shapes or colors (e.g., a star).

In some embodiments, a first inner compartment 221 extends into the inside 210 of the bottle portion 200 from the first side wall 201 (e.g., the intersection of the first side wall 201 and the top 206). In some embodiments, a second inner compartment 222 extends into the inside 210 of the bottle portion 200 from the second side wall 202 (e.g., the intersection of the second side wall 202 and the top 206) (see FIG. 4). In some embodiments, the first inner compartment 221 and/or the second inner compartment 222 is for storing a shot glass 400.

Disposed at the top 206 of the bottle portion 200 is a second hole for inserting or pouring liquid into or out of the inside 210 of the bottle portion, respectively. In some embodiments, a top cap 300 is removably attached to the second hole.

In some embodiments, the top cap 300 is a screw-on cap. In some embodiments, the top cap 300 has a top end 305 and a bottom end. In some embodiments, an open portion 350 is at the top end 305 of the top cap, and a female threaded portion 315 is at the bottom end of the top cap 300. In some embodiments, the open portion 350 of the top cap 300 functions as a shot glass. In some embodiments, the female threaded portion 315 of the top cap is for receiving a male threaded portion 310 in the second hole at the top 206 of the bottle portion 200 (see FIG. 4).

In some embodiments, the top end 305 of the top cap 300 (e.g., the open portion 350) is smooth, similar to standard shot glasses. This allows a user to drink comfortably from the top cap 300 when it is used as a shot glass.

In some embodiments, the top cap 300 (e.g., screw-on cap) is diamond-shaped. In some embodiments, the top cap 300 (e.g., screw-on cap) is constructed from a material comprising a colored glass.

The liquor bottle device 100 of the present invention may be used to store any type of liquor, such as whiskey, tequila, vodka, the like, or a combination thereof. The liquor bottle device 100 may be constructed in a variety of shapes, colors (e.g., gold, tan, white, blue, etc.), and designs.

The liquor bottle device 100 of the present invention may be constructed from a variety of materials. For example, in some embodiments, the liquor bottle device 100 is constructed from a material comprising a glass (e.g., colored glass), plastic, rubber, metal, the like, or a combination thereof.

In some embodiments, the liquor bottle device 100 is constructed from a material comprising a thermal glass, wherein the thermal glass can help keep the contents of the liquor bottle device cool.

The liquor bottle device 100 of the present invention may be constructed in a variety of sizes. The liquor bottle device 100 of the present invention may be constructed in a variety of shapes. In some embodiments, the bottom chamber 150 and/or bottle portion 200 is between about 3 to 4 inches in width as measured from the first side wall 201 to the second side wall 202. In some embodiments, the bottom chamber 150 and/or bottle portion 200 is between about 4 to 5 inches in width as measured from the first side wall 201 to the second side wall 202. In some embodiments, the bottom chamber 150 and/or bottle portion 200 is between about 5 to 6 inches in width as measured from the first side wall 201 to the second side wall 202. In some embodiments, the bottom chamber 150 and/or bottle portion 200 is more than about 6 inches in width. In some embodiments, different sized bottles can have different size widths.

In some embodiments, the bottom chamber 150 and/or bottle portion 200 is between about 1 to 2 inches in thickness as measured from the front face 203 to the back face. In some embodiments, the bottom chamber and/or bottle portion is between about 2 to 3 inches in thickness as measured from the front face 203 to the back face. In some embodiments, the bottom chamber 150 and/or bottle portion 200 is more than about 3 inches in thickness.

In some embodiments, the liquor bottle device 100 of the present invention is between about 4 to 6 inches in height as measured from the top end 305 of the cap 300 to the bottom of the bottle portion 200. In some embodiments, the liquor bottle device 100 of the present invention is between about 6 to 8 inches in height as measured from the top end 305 of the cap 300 to the bottom of the bottle portion 200. In some embodiments, the liquor bottle device 100 of the present invention is between about 8 to 10 inches in height as measured from the top end 305 of the cap 300 to the bottom of the bottle portion 200. In some embodiments, the liquor bottle device 100 of the present invention is more than about 10 inches in height.

As used herein, the term "about" refers to plus or minus 10% of the referenced number. For example, an embodiment wherein the bottom chamber 150 is about 5 inches in width includes a bottom chamber 150 that is between 4.5 and 5.5 inches in width.

The following the disclosures of the following U.S. patents are incorporated in their entirety by reference herein: U.S. Pat. No. 6,588,621 B2; U.S. Pat. Nos. 3,913,770; 4,323,172; U.S. Pat. No. 3,262,596.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A liquor bottle device comprising:

(a) a bottle portion for holding a liquid, said bottle portion having a front face, a back face, a top, a first side wall, and an inside (b) a bottom chamber disposed at the bottom of the bottle portion, wherein the bottom chamber is separated from the inside of the bottle portion via a top wall; wherein the bottom chamber is for holding ice as to cool the liquid held in the bottle portion;

(c) a first hole disposed in the first side wall of the bottle portion at the bottom chamber; wherein the first hole allows a user to insert or remove ice into or from the bottom chamber, respectively;

(d) a side cap removably attached to the first hole; wherein the side cap comprises a decoration;

(e) a first inner compartment extending into the inside of the bottle portion from an intersection of the first side wall and the top;

(f) a second inner compartment extending into the inside of the bottle portion from an intersection of the second sidewall and the top;

(g) a second hole disposed in the top of the bottle portion; wherein the second hole allows a user to insert or remove the liquid into or out of the inside the bottle portion, respectively; and (h) a top is removably attached to the second hole, wherein the top cap has a top end and a bottom end, wherein an open portion that functions as a shot glass is disposed at the top end;

(i) a first shot glass, wherein the first shot glass is inserted into the first inner compartment;

(j) a second shot glass, wherein the second shot glass is inserted into the second inner compartment.

2. The liquor bottle device of claim 1, wherein the liquid includes a liquor.

3. The liquor bottle device of claim 1, wherein the liquor bottle device is constructed from a material comprising a thermal glass.

* * * * *